US008552651B2

(12) United States Patent
Sugino et al.

(10) Patent No.: US 8,552,651 B2
(45) Date of Patent: Oct. 8, 2013

(54) HIGH FREQUENCY PLASMA GENERATION SYSTEM AND HIGH FREQUENCY PLASMA IGNITION DEVICE USING THE SAME

(75) Inventors: Masayoshi Sugino, Anjo (JP); Kazuki Fukatsu, Anjo (JP); Yoshitaka Tomita, Okazaki (JP); Masamichi Shibata, Toyota (JP); Yuya Abe, Kariya (JP)

(73) Assignees: Nippon Soken, Inc., Nishio (JP); Denso Corporation, Kariya (JP)

( * ) Notice: Subject to any disclaimer, the term of this patent is extended or adjusted under 35 U.S.C. 154(b) by 0 days.

(21) Appl. No.: 13/585,224

(22) Filed: Aug. 14, 2012

(65) Prior Publication Data

US 2013/0049593 A1 Feb. 28, 2013

(30) Foreign Application Priority Data

Aug. 22, 2011 (JP) ..... 2011-180378
Dec. 19, 2011 (JP) ..... 2011-277347

(51) Int. Cl.
*H05H 1/50* (2006.01)

(52) U.S. Cl.
USPC ..... 315/111.41

(58) Field of Classification Search
None
See application file for complete search history.

(56) References Cited

U.S. PATENT DOCUMENTS

2008/0048565 A1* 2/2008 Drean ..... 315/111.71
2010/0116257 A1 5/2010 Agneray et al.

FOREIGN PATENT DOCUMENTS

CA 2 246 608 3/2000

* cited by examiner

*Primary Examiner* — Crystal L Hammond
(74) *Attorney, Agent, or Firm* — Nixon & Vanderhye PC

(57) ABSTRACT

In a high frequency plasma generation system, a magnetic resonance section is provided as a frequency multiplier section between a discharge circuit and a power booster circuit. The magnetic resonance section extracts from a fundamental wave of a predetermined frequency generated by a frequency generator higher harmonic components, which are multiplied waves of the predetermined frequency and as high as two or more integer times of the fundamental wave. A resonance frequency of the power booster circuit and a first resonance coil is set to be equal to the frequency of the multiplied wave and match to equal a resonance frequency of the discharge circuit and a second resonance coil of the magnetic resonance section when a discharge electrode and a ground electrode are in a predetermined pressure range.

8 Claims, 9 Drawing Sheets

FIG. 4B COMPARATIVE EXAMPLE

HIGH FREQUENCY PLASMA GENERATION SYSTEM AND HIGH FREQUENCY PLASMA IGNITION DEVICE USING THE SAME

CROSS REFERENCE TO RELATED APPLICATION

This application is based on and incorporates herein by reference Japanese patent applications No. 2011-180378 filed on Aug. 22, 2011 and No. 2011-277347 filed on Dec. 19, 2011.

TECHNICAL FIELD

The present disclosure relates to a high frequency plasma generation system, which generates high frequency plasma by application of high frequency current between discharge electrodes. This high frequency plasma generation system is usable in a high frequency plasma ignition device, which discharges high frequency current for ignition of fuel mixture of a low ignitability in a combustion chamber of an internal combustion engine.

BACKGROUND ART

It is required recently to improve fuel economy and reduce environmentally harmful substances contained in combustion emissions of an internal combustion engine of a vehicle. For this purpose, an ignition device is required to provide superior ignition performance even in case of lean fuel mixture or turbo-charged fuel mixture.

A conventional power supply device for a high frequency ignition system (for example, JP 2010-522841A corresponding to US 2010/0116257 A1) includes a power supply circuit for supplying a plasma generation resonance circuit with a power source voltage at a frequency determined by a control signal outputted from a power supply circuit control device. The control device includes an interface for receiving a determination request for an optimal control frequency, an interface for receiving a detection signal indicating a measured voltage of a capacitor terminal of the power supply circuit, and a module for determining an optimal control frequency. This module supplies, when requested, the power supply circuit with series of different control frequencies for continuous ignition instruction. The module further determines the optimal control frequency based on the received detection signal.

According to the conventional high frequency ignition system, a high voltage is applied to each terminal of a resonator of a high frequency plug and a coil to generate sparks between electrodes of the plug and the coil. The high frequency resonator of the plug and the coil is driven at its resonance frequency only when a difference between the detection voltages measured at the capacitor terminal of the power supply circuit at time of starting ignition and time of terminating ignition is maximum. By using an electrically measured value of the voltage of the capacitor terminal, the optimal control frequency, which generally corresponds to the resonance frequency of the plasma generation resonator, is determined and stored. By using the stored optimal control frequency, energy supplied to the resonator formed of the plug and the coil is maximized.

According to the conventional high frequency plasma ignition device, when a pressure in a combustion chamber rises, a withstand voltage rises and a required voltage for starting the discharge increases. However, when the pressure in the combustion chamber rises due to abnormal combustion such as detonation (knocking), the pressure rise occurs after an insulating body in a discharge space has been broken by the high voltage supplied from the high voltage power source and the discharge has started. For this reason, the density of mixture present in the discharge space is increased and hence the discharge space allows current to flow readily therein. The amount of current flowing when the high frequency energy is inputted becomes greater than that flowing in a normal combustion condition. Thus, high frequency plasma of extremely large energy generates and causes remarkable wear in the discharge electrodes.

In the conventional high frequency plasma ignition device, the discharge part is not insulated from other control circuits. The high frequency noise generated at the discharge time affects control circuits such as an ECU and causes erroneous operation of the ECU and the like. Since not only the drive frequency is as high as more than 1 MHz but also the electric power supplied instantaneously is large, it is difficult to separate electrically by a normal transformer. It is thus necessary to effectively counter high frequency noises.

SUMMARY OF THE DISCLOSURE

It is therefore an object to provide an improved high frequency plasma generation system, which uses dielectric loss for heating fuel, reduces electrode wear by preventing an excessive current from flowing at time of abnormal combustion such as detonation by using a change in resonance frequency, and reduces high frequency noise by separating a power amplifier circuit and an ignition source.

According to one aspect, a high frequency plasma generation system is provided for use in, for example, a plasma ignition device for an internal combustion engine. The plasma generation system comprises a discharge circuit, a frequency generator, a power booster and a magnetic resonance section. The discharge circuit includes at least a pair of discharge electrodes. The frequency generator generates a fundamental wave of a predetermined frequency. The power booster circuit boosts electric power of a power source by the predetermined frequency, so that a high frequency plasma is generated by application of a high frequency voltage between the discharge electrodes. The magnetic resonance section is provided between the power booster circuit and the discharge circuit as a frequency multiplier section for extracting a multiplied frequency wave, which corresponds to higher harmonic wave components of the fundamental wave and has a multiplied frequency as high as two or more integer times of the predetermined frequency of the fundamental wave.

The magnetic resonance section includes a first resonance coil, a first capacitor connected to the first resonance coil, a second resonance coil and a second capacitor connected to the second resonance coil. The first resonance coil and the second resonance coil are provided to oppose each other with a predetermined spacing therebetween. An inductance of the first resonance coil, an inductance of the second resonance coil, a capacitance of the first capacitor, a capacitance of the second capacitor and the multiplied frequency of the multiplied frequency wave are determined such that a resonance frequency of the power booster circuit and the first resonance coil is matched to equal the multiplied frequency of the multiplied frequency wave, and matched to equal a resonance frequency of the discharge circuit and the second resonance coil when the discharge electrodes are in a predetermined pressure range, outside of which the resonance frequency of the discharge circuit and the second resonance coil varies.

BRIEF DESCRIPTION OF THE DRAWINGS

The above and other objects, features and advantages will become more apparent from the following detailed description made with reference to the accompanying drawings. In the drawings:

FIG. 4B is a block diagram showing a comparative example;

DETAILED DESCRIPTION OF THE EMBODIMENT

Figure 1A:
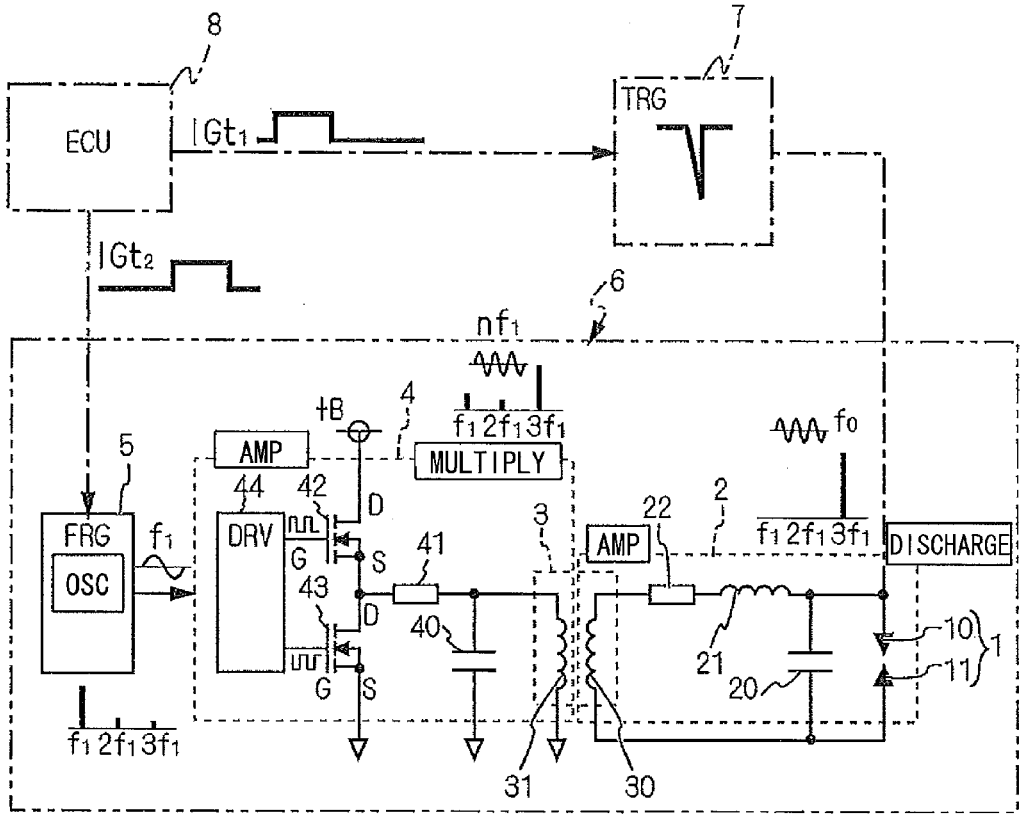
FIG. 1A is a block diagram showing a high frequency plasma generation system according to a first embodiment used in a plasma ignition device.

A high frequency plasma generation system will be described below with reference to various embodiments, in which the plasma generation system is incorporated in a plasma ignition device for an internal combustion engine.

First Embodiment

Referring to FIG. 1, a high frequency plasma generation system is designated by reference numeral 6. The plasma generation system 6 is formed of an ignition plug 1, a discharge circuit 2, a magnetic resonance section 3, a power booster circuit 4 and a frequency generator 5. The magnetic resonance section 3 is provided between the discharge circuit 2 and the power booster circuit 4 as a frequency multiplication section, which outputs a multiplied wave having a frequency corresponding to higher harmonics of an inputted frequency and to integer times (n: two or more) of a fundamental frequency. A resonance frequency f2 of the power booster circuit 4 and a first resonance coil 31 of the magnetic resonance section 3 is set to equal the frequency (n×f1) of the multiplied wave. Further, the resonance frequency f2 is set to equal a resonance frequency f0 of the discharge circuit 2 and a second resonance coil 30 of the magnetic resonance section 3 under a condition that discharge electrodes 10 and 11 of the ignition plug 1 are in a predetermined pressure range.

The ignition plug 1 is mounted on an internal combustion engine (not shown) and has at least a pair of electrodes as the discharge electrodes 10 and 11, which are insulated from each other. The electrode 11 is grounded to operate as a ground electrode.

Figure 1B:
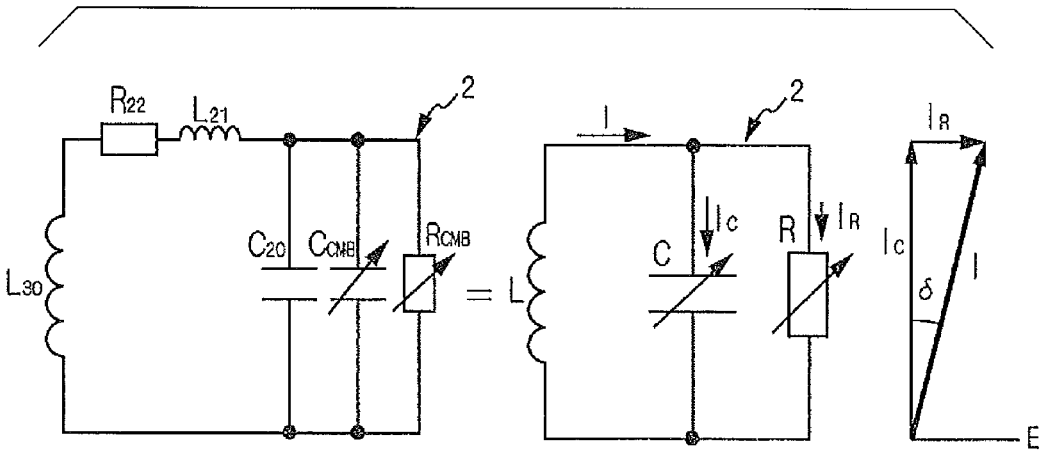
FIG. 1B is an electric equivalent circuit diagram of a discharge part in the first embodiment at time of discharge operation.

As shown in FIG. 1B, the discharge circuit 2 is formed as an LCR circuit. The LCR circuit has, as an inductive component, a composite inductance L, which is a composite of an inductance L30 of the secondary coil 30 of the magnetic resonance section 3 and a parasitic inductance L21 of a wire connecting the secondary coil 30 and the ignition plug 1. The LCR circuit also has, as a capacitive component, a composite conductance C, which is a composite of a parasitic capacitance C20 formed between the discharge electrodes 10 and 11 of the ignition plug 1 and a parasitic capacitance CCMB formed in a discharge space, which corresponds to a combustion chamber of the engine. The LCR circuit further has, as a resistance component, a composite resistance R, which is a composite of a resistance of the wire and a discharge resistance RCMB developed at a start of discharge in the discharge space.

The parasitic capacitance CCMB of the discharge space, which forms a major percentage of the conductance C of the discharge circuit 2, varies in inverse proportion to the pressure P in the discharge space (combustion chamber), which is represented as PCMB. Therefore, the resonance frequency f0 of the discharge circuit 2 is proportional to a square root of the pressure in the combustion chamber as understood from the following equations.

$$I_R/I_C=1/(\omega\times C\times R)=\tan\delta,\ \omega 0=1/\sqrt{(L\times C)},$$

$$f0=\omega 0/2\pi=1/\{2\pi\times\sqrt{(L\times C)}\}=k\sqrt{P_{CMB}}$$

In the magnetic resonance section 3, the first resonance coil 31 of N1 turns and the second resonance coil 30 of N2 turns are located to oppose each other with a spacing of a predetermined distance so that the first resonance coil 31 and the second resonance coil 30 are electrically insulated. This distance of separation is far shorter than a wavelength of the resonance frequency.

According to the conventional method of energy transmission by way of electromagnetic induction, an AC current is supplied to a primary coil of an ignition coil with a secondary coil being located closely to generate magnetic flux in the secondary coil and generate a current in the secondary coil. In the first embodiment, however, electric power is supplied from a primary side to a secondary side by way of magnetic resonance, which does not generate magnetic field.

Since the first resonance coil 31 and the second resonance coil 30 are used as a resonator, the magnetic field is caused to vibrate by a current supplied to the first resonance coil 31 and transmitted to the second resonance coil 30, which forms the resonance circuit and resonates at the same frequency, thereby generating magnetic resonance.

Since the first resonance coil 31 and the second resonance coil 30 are provided closely with only a small distance of separation, which is sufficiently shorter than the wavelength of the resonance frequency, the vibration of magnetic field is transmitted and causes the current in the second resonance coil 30.

In the transmission of electric energy by the magnetic resonance, the magnetic field is not generated. As a result, magnetic noise is suppressed and hence other electronic control devices are not affected by the electromagnetic noises.

According the plasma ignition device shown in FIG. 1A, a high voltage is applied as a trigger TRG from a high voltage DC power source 7 provided separately from the plasma generation system 6. The voltage transformation ratio (N2/N1) of the magnetic resonance section 3 may be set to provide a secondary voltage of about hundreds of volts from a primary voltage V1 of about several volts to tens of volts.

The first resonance coil 31 and the second resonance coil 30 of the magnetic resonance section 3 form a resonance circuit with the power booster circuit 4 and the discharge circuit 2, respectively. The power booster circuit 4 forms a class D amplifier circuit with a first capacitor 40, a resistor 41, switching devices (for example, power MOSFETs) 42, 43 and a driving circuit (driver) 44, which alternately turns on and off the switching devices 42 and 43. The driver 44 outputs gate voltages, which alternately turn on and off the switching devices 42 and 43 at a frequency f1 provided by the frequency generator 5, which includes an oscillator.

In the power booster circuit 4, the capacitor 40 is charged by the power source +B and discharged repetitively, and amplified. As a result, the power determined by the frequency f1 is applied to the first resonance coil 31 of the coil 30. By matching impedances of the resistor 41, the capacitor 40 and the first resonance coil 31, it is possible to extract the higher harmonics of the input frequency f1 inputted from the frequency generator 5 and generate the multiplied frequency wave having a multiplied frequency f2 (=n×f1), which is integer times (n: two or more) as high as the input frequency f1.

The frequency generator 5 is not limited to the disclosed one but may be a conventional frequency generator. The frequency f1 generated by the frequency generator 5 may be a sinusoidal wave or a rectangular wave (pulse wave).

Specifically, the frequency generator 5 may be a conventional sinusoidal wave generation circuit using operational amplifiers or a conventional DDS (direct digital synthesizer) using a D-A converter. The rectangular wave may be generated by a rectangular wave generation circuit using operational amplifiers or by frequency-dividing a high frequency clock.

The high voltage DC power source 7 is not limited to a specific type but may be an inductive discharge type (TCI, transistor coil ignition), which induces high voltages for discharge by supplying and interrupting application of power to an ignition coil. It may also be a capacitive type (CDI, capacitor discharge ignition), which supplies high voltages by cumulatively discharging the energy charged in a capacitor.

An electronic control unit (ECU) 8 applies, in accordance with operation conditions of the internal combustion engine, a first ignition signal IGt1 to the high voltage power source 6 and a second ignition signal IGt2 to the frequency generator 4, respectively.

Figure 2A:
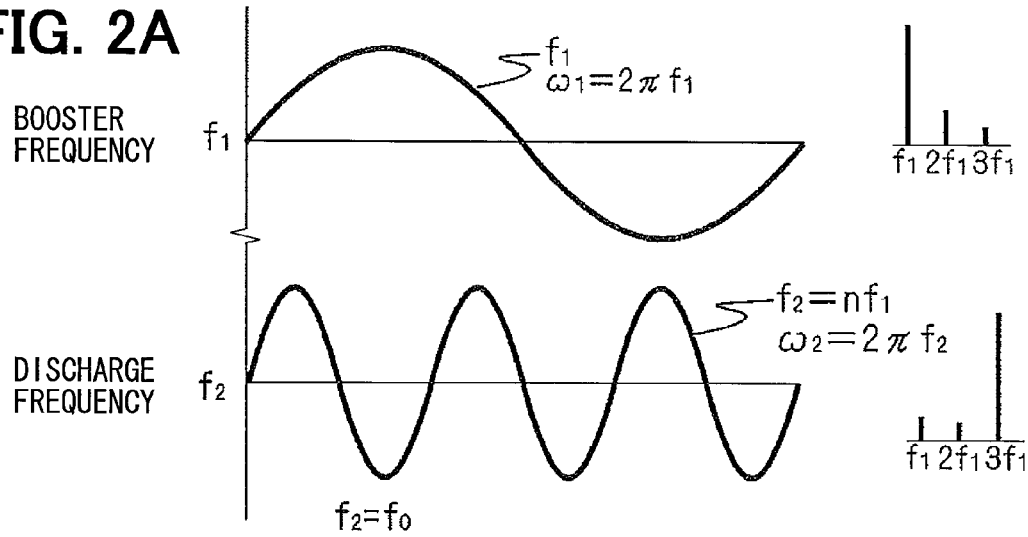
FIG. 2A is a waveform chart showing a relation between an input waveform and an output waveform generated in the first embodiment.

The operation of the plasma ignition device including the plasma generation system 6 will be described with reference to FIGS. 2A to 2C.

The driver 44 controls turn-on and turn-off of the switching devices 42 and 43 in response to the input signal of frequency f1 inputted from the frequency generator 5 to the power booster circuit 4, so that the capacitor 40 charges and discharges to boost electric power. By the resonance of the capacitor 40 and the first resonance coil 31, as shown in FIG. 2A, the multiplied frequency f2 (=n×f1) of the specified frequency f1 is extracted from the higher harmonics of multiplied frequencies (2×f1, 3×f1, and so on) of the fundamental frequency f1, and inputted to the discharge circuit 2 through the magnetic resonance section 3.

Figure 2B:
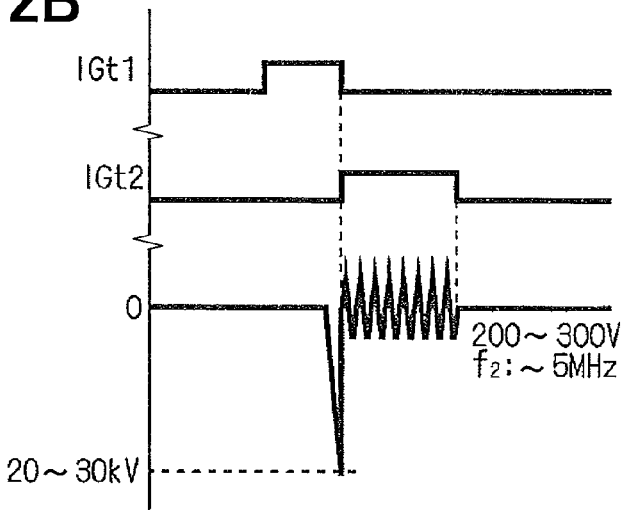
FIG. 2B is a time chart showing an operation of the first embodiment.

As shown in FIG. 2B, when the first ignition signal IGt1 is outputted from the ECU 8, the high voltage of about 20 to 30 kV is applied from the high voltage power source 7 to the ignition plug 1 in synchronism with the fall of the first ignition signal IGt1, so that the insulation between the discharge electrodes 10 and 11 is broken to start a trigger discharge. This high voltage has energy, which has been stored in the high voltage power source 7 during the ON-period of the first ignition signal IGt1.

When the second ignition signal IGt2 is outputted from the ECU 8, the high frequency wave having the multiplied frequency f2 is inputted to the discharge circuit 2 as described above.

Figure 2C:
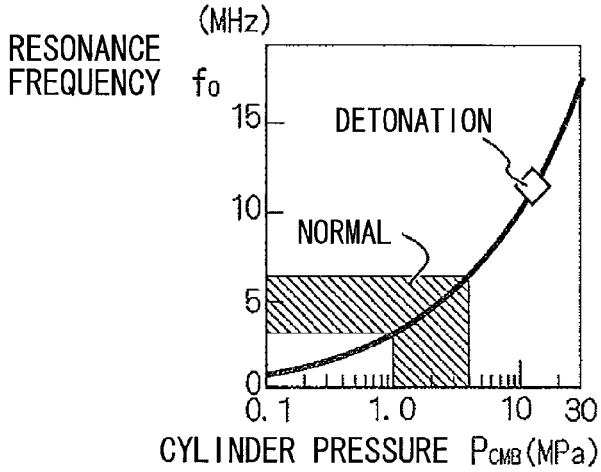
FIG. 2C is a graph showing a characteristic diagram showing an operation of the first embodiment.

The resonance frequency f0 of the discharge circuit 2 varies in proportion to a square root of pressure P in the discharge space as shown in FIG. 2C. In a predetermined pressure range (indicated by slashed lines as a normal range in FIG. 2C), in which the resonance frequency f0 of the discharge circuit 2 and the frequency f2 of the multiplied wave (for example, 5 MHz) generated from the power booster circuit 4 agree, a high frequency plasma current flows between the discharge electrodes 10 and 11. Thus, high temperature plasma is generated and fuel mixture suctioned into the discharge space (combustion chamber) is ignited.

When the pressure P in the combustion chamber is high because of abnormal combustion such as detonation, the resonance frequency f0 of the discharge circuit 2 increases and does not agree to the multiplied wave frequency f2 generated from the power booster circuit 4. As a result, the plasma current does not flow between the discharge electrodes 10 and 11.

Since the discharge of high frequency current does not occur under a condition that the pressure P in the combustion chamber P is too high and the parasitic resistance RCMB in the discharge space is too low due to abnormal combustion, the electrodes 10 and 11 are protected from excessive wear, which is caused by the discharge of excessive current.

The fundamental frequency, which equals the frequency f1 generated by the frequency generator 5, is not matched to equal the resonance frequency f0 of the discharge circuit 2. Rather, the multiplied wave frequency f2 using the higher harmonics is matched to equal the resonance frequency f0 of the discharge circuit 2. Thus, the switching of the switching devices 42 and 43 can be performed at the fundamental frequency f1, which is as low as 1/n of the resonance frequency f0, and hence costs of switching devices may be comparatively lowered.

The first embodiment provides the following advantage as described with reference to FIGS. 3A and 3B.

Figure 3A:
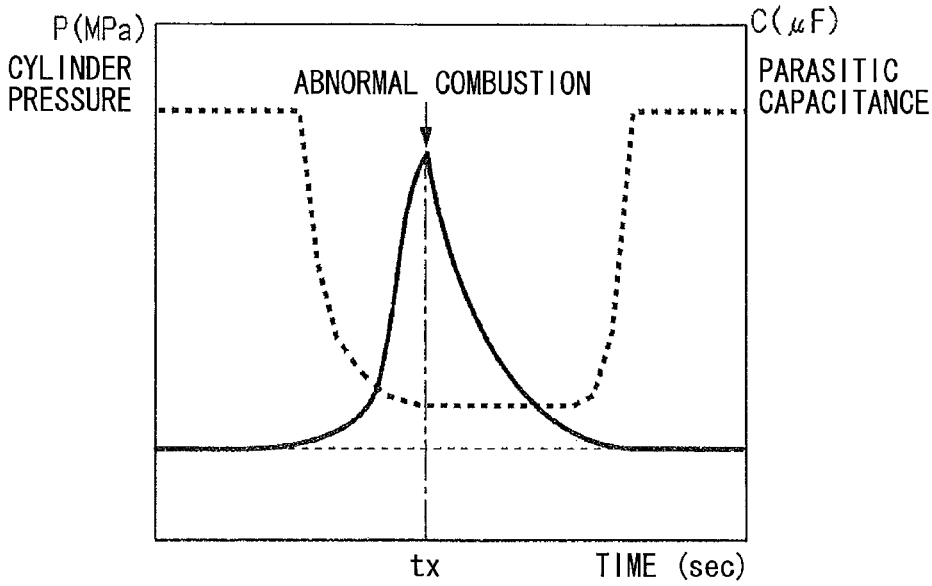
FIG. 3A is a characteristic diagram showing changes in a cylinder inside pressure and changes in a parasitic capacitor in a discharge space.

FIG. 3A shows time changes of the pressure P (Mpa) in the combustion chamber, that is, cylinder pressure (solid line), and the parasitic capacitance CCMB (dotted line) in the discharge space at the time of abnormal combustion. FIG. 3B shows the discharge current I (A) flowing in the first embodiment (solid line) and a comparative example (dotted line). In the comparative example, the fundamental wave of the conventional power booster circuit is assumed to be matched to the resonance frequency of the discharge circuit 2.

Figure 3B:
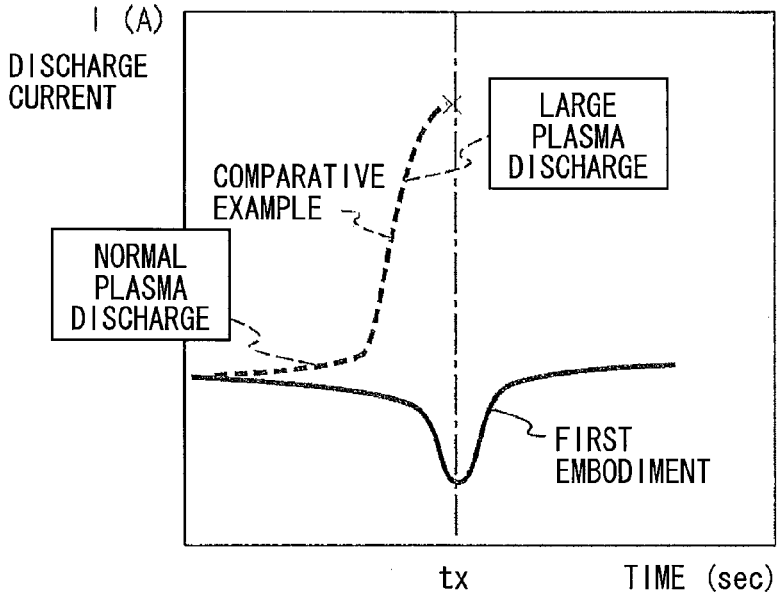
FIG. 3B is a characteristic chart showing an advantage of the first embodiment provided at the time of abnormal combustion in comparison with a comparative example.

When the pressure P (Mpa) in the combustion chamber is increased due to the abnormal combustion such as detonation at time tx as shown in FIG. 3A, the discharge current I (A) ceases to flow in the first embodiment as shown in FIG. 3B and hence excessive electrode wear is suppressed. However in the comparative example, when the abnormal combustion arises after the normal plasma discharge, a very intense discharge current flows and sharply rises as shown in FIG. 3B. As a result, the electrodes are damaged by fire and may not be able to perform discharge operation.

Second Embodiment

Figure 4A:
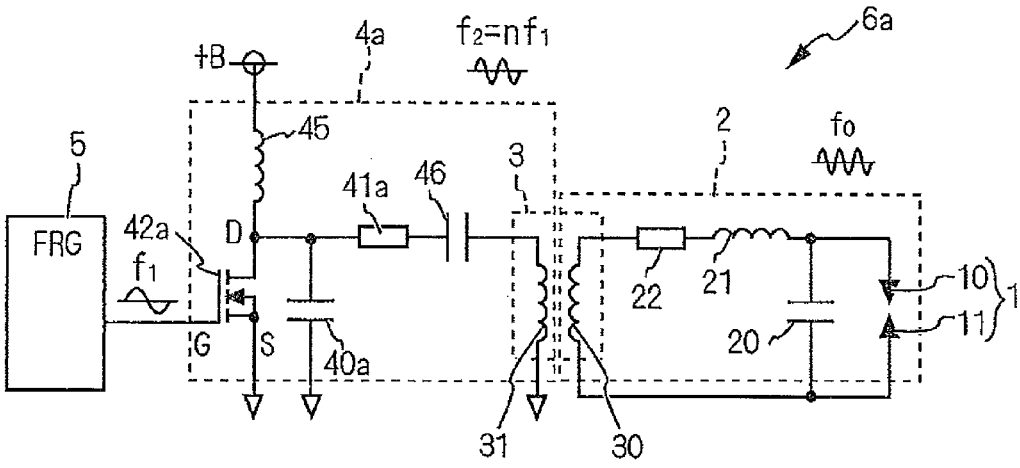
FIG. 4A is a block diagram showing a high frequency plasma generation system according to a second embodiment.
Figure 4A:
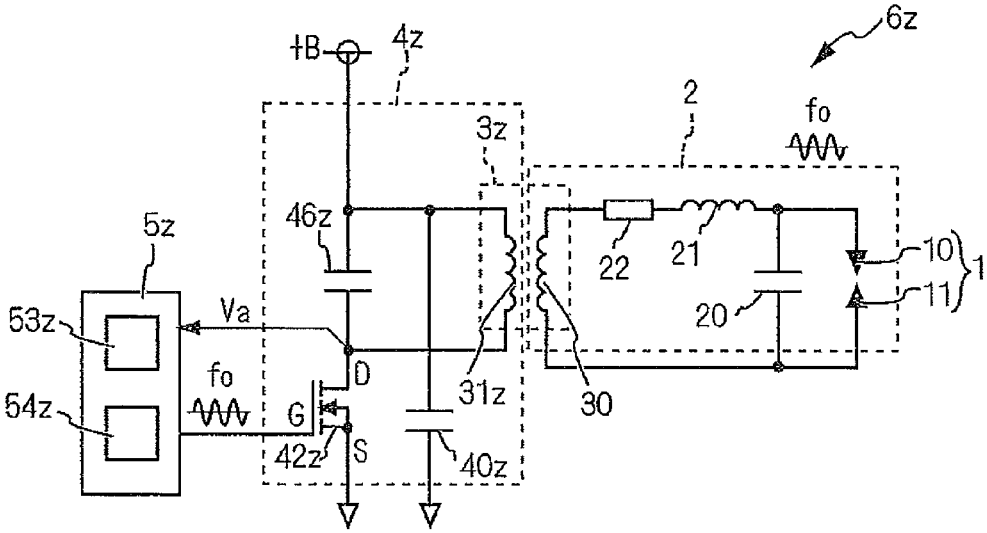

A high frequency plasma generation system 6*a* according to a second embodiment is shown in FIGS. 4A and 4B.

FIG. 4A is an equivalent circuit diagram showing the plasma generation system 6*a* according to the second embodiment, and FIG. 4B is also an equivalent circuit diagram of a comparative example, which corresponds to a conventional high frequency plasma generation system 6*z*. In the comparative example, the same or similar parts as the first embodiment are designated by the same reference numerals and different parts are designated by addition of suffix "z" to reference numerals to clarify difference from the second embodiment.

Although the class D amplifier circuit is used in the power booster circuit 4 in the first embodiment, a class E amplifier circuit is used in the second embodiment as a power booster circuit 4*a*, which is more simplified in configuration, as shown in FIG. 4A.

The power booster circuit 4*a* has a third resonance coil 45 or a parasitic inductance between the DC power source +B and a switching device 42*a*. A resistor 41*a* and a second capacitor 46 are provided in series between the drain of the switching device 42*a* and the first resonance coil 31. In addition, a first capacitor 40*a* is provided in parallel to the drain of the switching device 42*a* and the resistor 41*a*. The fundamental frequency f1 is inputted from the frequency generator 5 to the switching device 42*a* and the switching device 42*a* is driven to turn on and off by the fundamental frequency f1.

In case that the output voltage of the alternating current signal or the high frequency pulse generated by the frequency generator 5 is low, a gate driver, a booster circuit may be additionally provided to assure the gate voltage necessary to turn on and off the gate of the switching device 42*a*. Alternatively, the gate may be pulled up to a power source by a pull-up resistor.

According to the second embodiment, the resonance frequency of the first resonance coil 31 of the magnetic resonance section 3 and the second capacitor 46 is matched to the resonance frequency corresponding to the higher harmonics of the fundamental frequency f1 to output the multiplied frequency f2 (=n×f1). Thus similarly to the first embodiment, only when the resonance frequency f0 of the discharge circuit 2 coincides the multiplied wave of frequency f2, the plasma is generated. As a result, the electrodes 10 and 11 of the ignition plug 1 are protected from excessive wear. In addition, only one switching device 42*a* is used, the manufacturing cost is further reduced and the device is sized smaller.

According to the conventional plasma generation system 6*z* shown in FIG. 4B as the comparative example, the fundamental frequency generated from the frequency generator 5*z* and the resonance frequency f0 of the discharge circuit 2 are matched to be equal without using the multiplied wave. As a result, a switching device 42*z* need be a high frequency switching device, which is capable of performing a switching operation at a high frequency of about 4 MHz, for example, and is expensive, and hence adds manufacturing costs.

Further, in the comparative example, the oscillation frequency f1 of the frequency generator 5*z* is determined to substantially match the resonance frequency f0 of the discharge circuit 2 to maximize the energy transferred to the discharge circuit 2 by monitoring a drain voltage Va of the switching device 42*z*. In this example, when the pressure in the combustion chamber rises due to abnormal combustion or the like, it is not possible to avoid discharge of excessive high frequency current. It is hence likely that the discharge electrodes 10 and 11 remarkably wear.

Third Embodiment

Figure 5A:
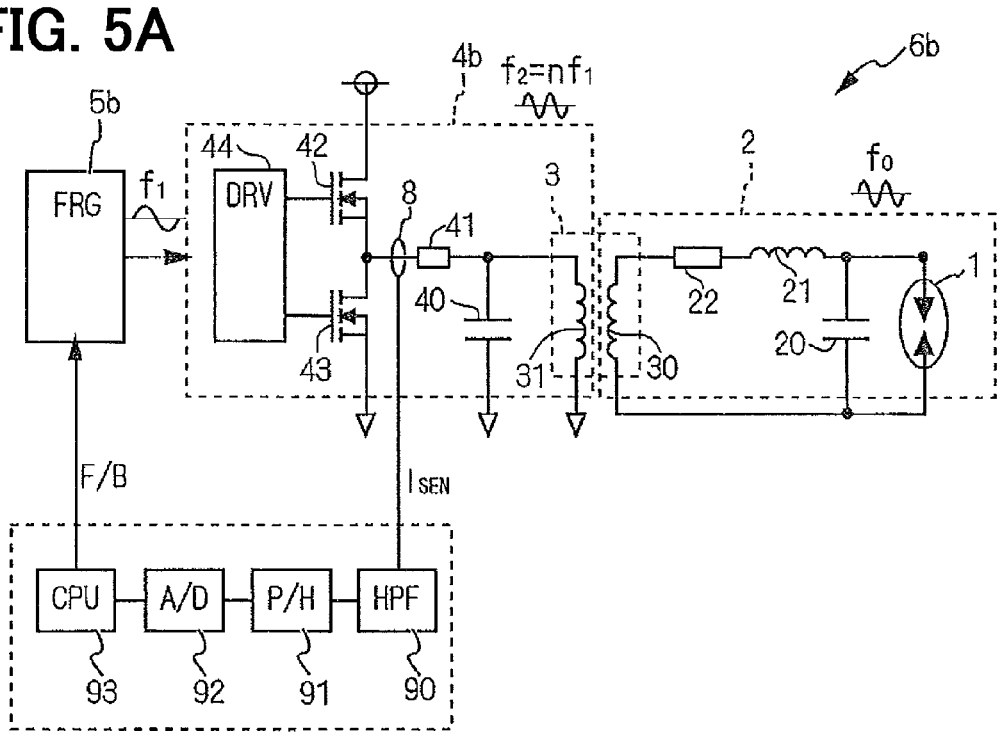
FIG. 5A is a block diagram showing a high frequency plasma generation system according to a third embodiment.
Figure 5B:
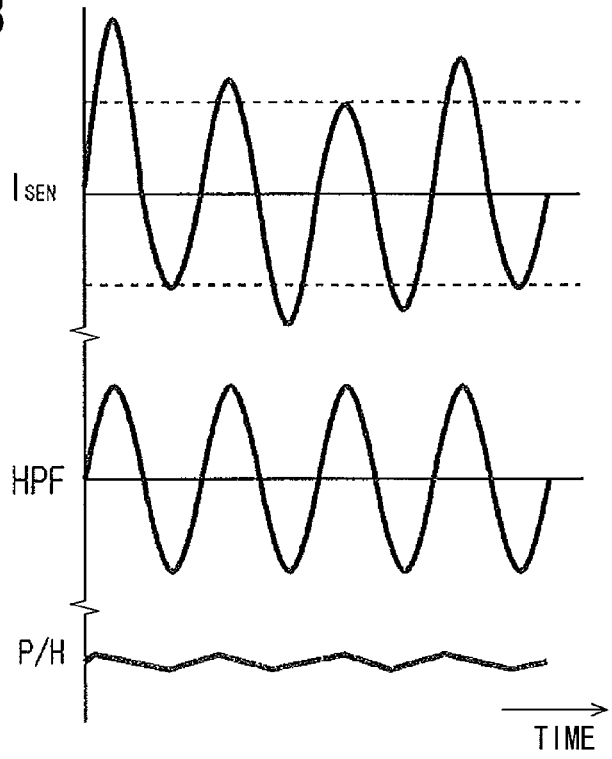
FIG. 5B is a waveform chart showing an advantage of the third embodiment.

A high frequency plasma generation system 6*b* according to a third embodiment and a control method executed in the third embodiment will be described with reference to FIGS. 5A, 5B and 6.

In the third embodiment, the plasma generation system 6*b* has as a basic structure the plasma generation system 6 or 6*a* of the first or the second embodiments. In addition, as shown in FIG. 5A, a power booster circuit 4*b* is provided with a current detector 8, which detects a high frequency current inputted to the first resonance coil 31. The current detector 8 is connected to a feedback control circuit, which includes a high-pass filter (HPF) 90, a peak hold circuit (P/H) 91, an A/D converter 92 and a control microcomputer (CPU) 93. The high-pass filter 90 removes from a detected current ISEN low frequency components generated by deviation of the resonance frequency as shown in FIG. 5B. In addition, a peak hold circuit (P/H) 91 samples and hold a peak of the output of the high-pass filter 90 as shown in FIG. 5B. The A/D converter 92 digitizes an output voltage of the peak-hold circuit 91 indicating detected and sample-held current. The control microcomputer 93 arithmetically processes digitized data and feeds back to a frequency generator 5*b*. The frequency generator 5*b* is configured to have an additional function of increasing and decreasing the oscillation frequency f1 by feedback in correspondence to a correction data from the control microcomputer 93.

Figure 6:
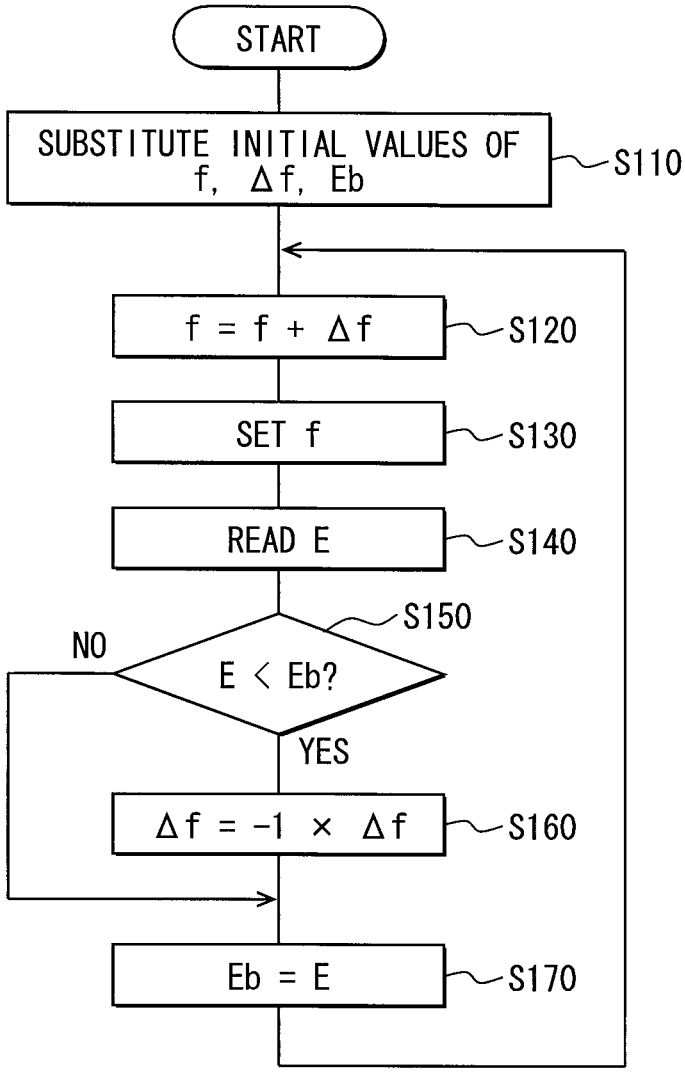
FIG. 6 is a flowchart showing one exemplary control method used in the third embodiment.

The microcomputer 93 is programmed to correct changes in frequency caused by aging in accordance with the processing shown in FIG. 6 to generate high frequency plasma more stably.

Referring to FIG. 6, a frequency correction process is started when the second ignition signal IGt2 is inputted from the ECU 8.

In an initialization process in step S110, initial values of a frequency f, a frequency correction value Δf and a buffer value Eb of a peak-hold voltage E are substituted.

In a frequency correction process in step S120, the frequency f is corrected by addition of the correction value Δf.

In a frequency setting process in step S130, a corrected frequency f is fed back to the frequency generator 5 to set the oscillation frequency of the frequency generator 5 as the fundamental frequency f1.

In a peak-hold read process in step S140, a present value E of the peak-hold value is measured and read in.

In a peak-hold value check process in step S150, the present value E is compared with a buffer value Eb. If the present value E is less than the buffer value Eb, the check result is YES, step S160 is executed. If the present value is equal to or greater than the buffer value Eb, the check result is NO. In this case, step S170 is executed.

In a frequency increase/decrease switching process in step S160, the correction value Δf is multiplied by −1 to reverse the direction of frequency change and step S170 is executed.

In the buffer value substitution process in step S170, the present value E is substituted for the buffer value Eb and step S120 is executed again.

By repetition of a loop from step S120 to step S170, change by aging or the like is accurately corrected and the oscillation frequency is stably regulated by the feedback control.

Fourth Embodiment

A high frequency plasma generation system according to a fourth embodiment will be described with reference to FIG. 7.

In the above-described embodiments, the first resonance coil 31 and the second resonance coil 30 forming the magnetic resonance section 3 are separated to oppose each other with the predetermined spacing therebetween. It is assumed in the above-described embodiments that the parasitic capacitance CCMB formed in the discharge space occupies a high percentage of the conductance C of the discharge circuit 2.

According to the fourth embodiment, however, the high frequency power source has a connector part 9 formed of a series circuit of a first resonance coil 31*c* of an inductance L1 and a first capacitor 40*c* of the capacitance C1. A discharge circuit 2*c* has a series circuit formed of a second resonance coil 30*c* of an inductance L2 and a second capacitor 20*c* of a capacitance C2. A plug section 1*c* is formed by insertion of the discharge electrode 10 in parallel to the second resonance coil 30*c* or the capacitor 20*c*.

A high frequency power signal is applied to the connector part 9 at a drive frequency fa. The inductance L1 of the first resonance coil 31, the inductance L2 of the second resonance coil 30*c*, the capacitance C1 of the first capacitor 40*c*, the capacitance C2 of the capacitor 20*c* and the drive frequency fa are set, so that the first resonance coil 31*c* and the second resonance coil 30*c* both have high Q-factor of resonance and a resonance frequency fb of the connector section 9 and a resonance frequency fc of the plug section 1*c* match.

Figure 8A:
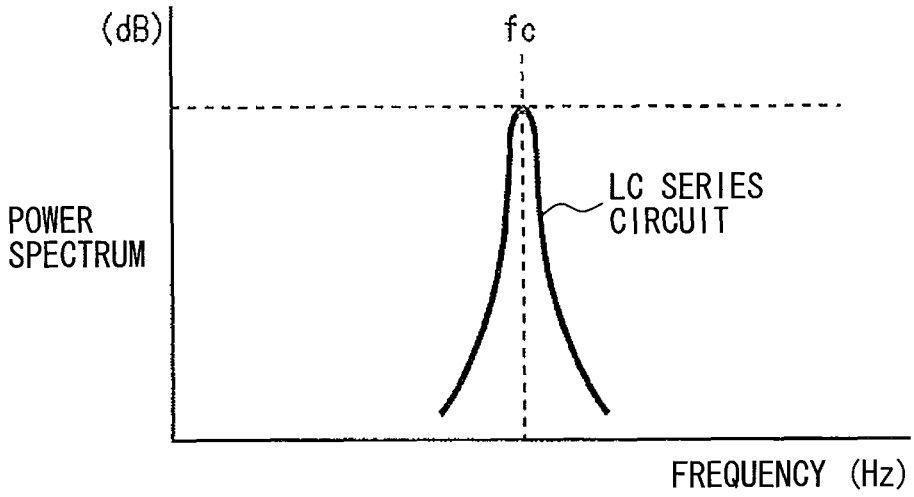
FIG. 8A is a frequency characteristic chart of one LC series circuit.

This drive frequency fa is set such that the resonance frequency fb of a first LC series resonance circuit formed of the first capacitor 40*c* (C1) and the first resonance coil 31*c* (L1) matches to equal the resonance frequency fc of a second LC series resonance circuit formed of the second capacitor 20*c* (C2) and the second resonance coil 30*c* (L2). The drive frequency fa is determined based on the frequency characteristic shown in FIG. 8B. This characteristic is exhibited by the magnetic resonance operation when the first resonance coil 31*c* and the second resonance coil 30*c* are provided in a radial direction within a predetermined small distance. The drive frequency is shifted from the resonance frequency fc, which is shown in FIG. 8A as the resonance frequency of one LC series circuit.

By transmitting power in this frequency fa, the power is transferred highly efficiently between the first resonance coil 31*c* and the second resonance coil 30*c* by the magnetic resonance operation.

In the plug section 1*c*, the capacitor 20*c* and the second resonance coil 30*c* are connected in series through a metal body 13 of the plug section 1*c*. In addition, the discharge electrode 10 is provided in parallel to the capacitor 20*c* or the second resonance coil 30*c*.

Figure 7:
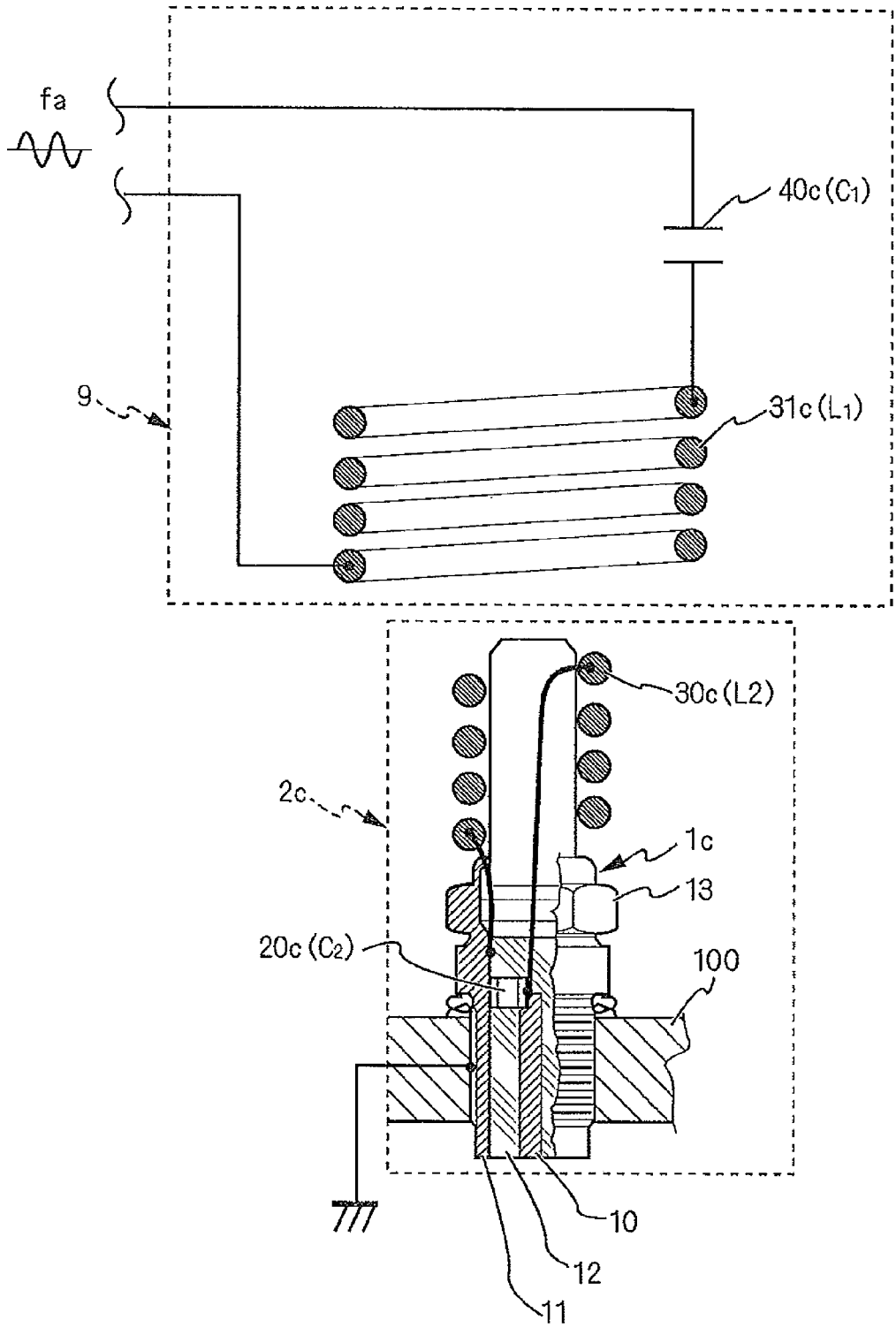
FIG. 7 is a sectional view showing a main part of a high frequency plasma ignition device using a high frequency generation system according to a fourth embodiment.

Although the capacitor 20*c* and the discharge electrode 10 are connected in parallel as shown in FIG. 7, the discharge electrode 10 may be provided in parallel to the second resonance coil 30*c*.

A top end of a housing 13 of the ignition plug forms the ground electrode 11, and the ground electrode 11 and the discharge electrode 10 are insulated by a tubular insulator 12. The housing 13 is mounted on an engine head 100 and grounded.

In the fourth embodiment, the discharge electrode 10 and the ground electrode 11 are made of conventional electrically conductive metal material such as nickel alloy or the like having high thermal resistance. The housing 13 is made of a conventional metal material such as stainless, carbon steel or the like, which has high thermal resistance and high electric conductivity. The insulator 12 is made of a conventional insulation material such as alumina.

Figure 8B:
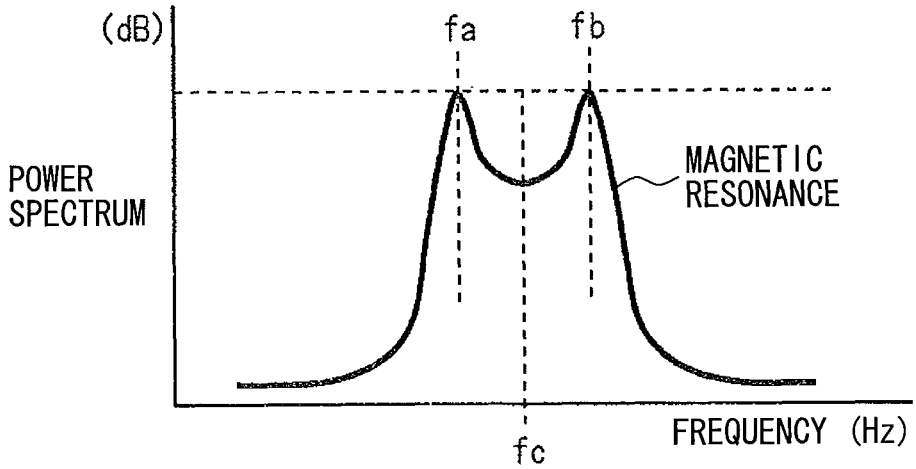
FIG. 8B is a frequency characteristic chart of a magnetic resonance.

As shown in FIG. 8A, the frequency characteristic of the LC series circuit has a peak in the power spectrum at the resonance frequency fc. As shown in FIG. 8B, however, the frequency characteristic of the magnetic resonance, has peaks in the power spectrum at two frequencies. One is the first frequency fa lower than the resonance frequency fc of one LC series circuit and the other is the second frequency fb higher than the resonance frequency fc of one LC series circuit.

For this reason, in the magnetic resonance section 3, the resonance frequency of the connector section 9 formed of the first resonance coil 31*c* and the first capacitor 40*c* is set to fc, and the resonance frequency of the plug section 1*c* formed of the second resonance coil 30*c* and the capacitor 20*c* is set to fc. Further, the first resonance coil 31*c* and the second resonance coil 30*c* are provided to oppose each other in the radial direction to generate magnetic resonance. Either one of the first frequency fa and the second frequency fb generated by the magnetic resonance is selected as the drive frequency.

Figure 9A:
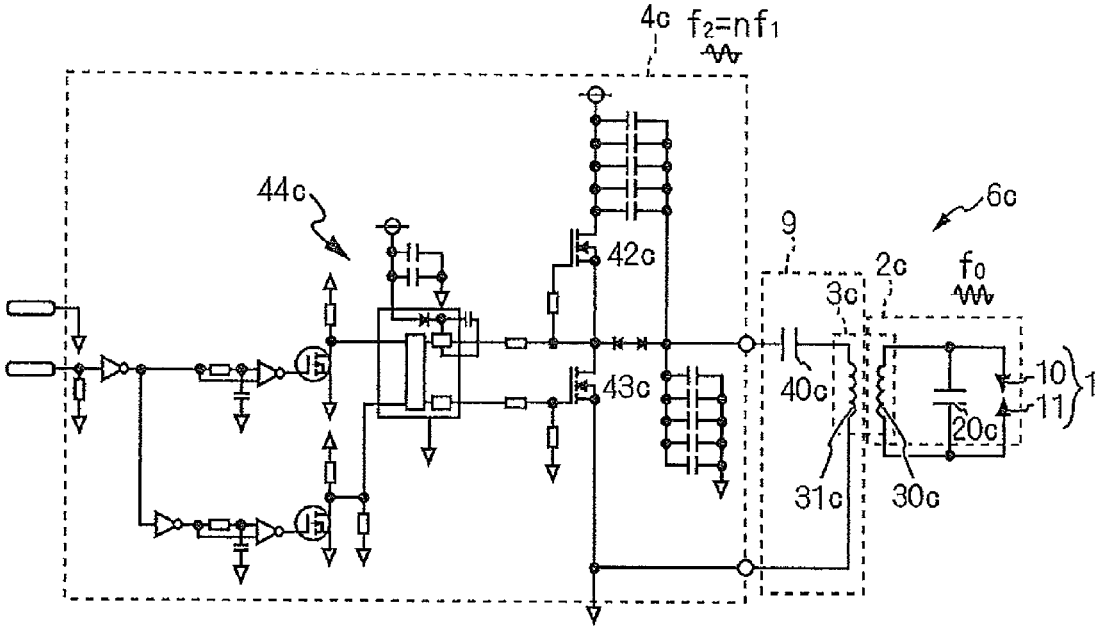
FIG. 9A is a circuit diagram showing details of the plasma generation system according to the fourth embodiment.
Figure 9B:
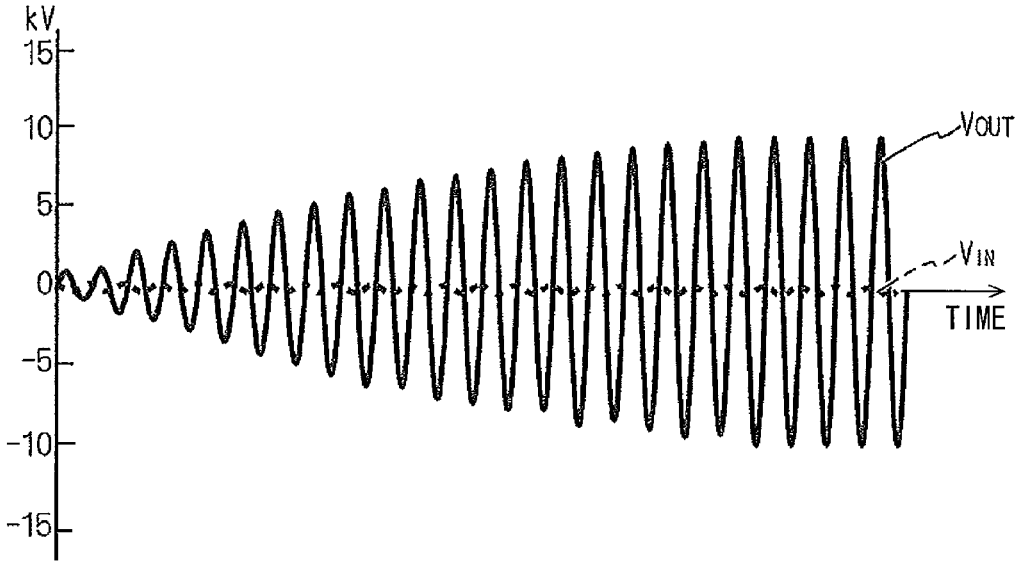
FIG. 9B is a waveform chart showing a simulation result of the circuit shown in FIG. 9A.

A simulation was conducted by using a power booster circuit 4*c* including a driver circuit 44*c* and switching devices 42*c* and 43*c* as shown in FIG. 9A. The result of simulation is shown in FIG. 9B, which indicates a relation between an applied voltage VIN and a discharge voltage VOUT.

Here, the high frequency power source 4*c* was configured as a class D amplifier to apply a high frequency signal. However, other circuits such as a class E amplifier may be used as far as the high frequency power of frequencies in the order of MHz can be amplified.

In this simulation, the drive voltage of 100V at the drive frequency fa (10 MHz as an example) was applied to the circuit having the resonance frequency 10 MHz. As a result, the discharge voltage was raised to 10 kVP-P in about 5 μs after application of the voltage and the resonance caused no delay in the discharge.

Since the power was transmitted by the magnetic resonance, the electromagnetic field was not generated and hence influence of noise to external control devices such as ECUs provided outside was suppressed.

The inductance L1 of the first resonance coil 31*c*, the capacitance C1 of the first capacitor 40*c*, the inductance L2 of the second resonance coil 30*c* and the capacitance C2 of the second capacitor 20*c* were set such that the Q-factor of resonance is higher than 100 and both of the connector section 9 and the plug section 2*c* have the same resonance frequencies fc. Further, the first resonance coil 31*c* was driven by the drive frequency fa to generate the magnetic resonance with the second resonance coil 30*c* assembled to the plug 1*c* side. As a result, although no electric contact was provided between the plug 1*c* and the connector section 9, the plasma discharge could be provided between the discharge electrode 10 and the ground electrode 11.

With the Q-factor of resonance, the discharge voltage VOUT is expressed as a function of the input voltage VIN as $VOUT=Q\times VIN$. In the series resonance circuit having the inductance L and the capacitance C, the Q-factor is expressed as $Q=(1/R)\times\sqrt{(L/C)}=\omega L/R=1/\omega CR$. Here, ω, R, L and C are angular frequency, series resistance, inductance and capacitance, respectively.

For higher Q-factor of resonance, the inductance L is set larger and the capacitance C and the series resistance R are set smaller.

In the foregoing embodiments, the ignition plug forming a part of the discharge circuit is not limited to a specific structure. A conventional ignition plug may be used, as far as it generates high frequency plasma by a supply of high frequency current triggered by a discharge arc generated by a high voltage and attains ignition in the engine.

A first example is a spark plug-type ignition plug, in which a longitudinally-extending center electrode and a L-shaped ground electrode face each other. A second example is a plasma jet plug, in which a longitudinally-extending center electrode is covered with a tubular insulator, a ground electrode is provided generally annularly at is top end, so that the top end of the center electrode and an inner periphery of the ground electrode face each other in a discharge space provided inside the insulator. A third example is a surface discharge plug, in which a discharge path is formed along a surface of an insulator disposed between a center electrode and a ground electrode. A fourth example is a silent electric discharge-type ignition plug, in which a center electrode is elongated into a combustion chamber of an internal combustion engine. A fifth example is a coaxial resonator tube-type high frequency ignition plug, in which a central conductor for introducing a high frequency and a bottomed tubular resonator are disposed coaxially.

What is claimed is:

1. A high frequency plasma generation system comprising:

a discharge circuit including at least a pair of discharge electrodes;

a frequency generator for generating a fundamental wave of a predetermined frequency;

a power booster circuit for boosting electric power of a power source by the predetermined frequency, so that a high frequency plasma is generated by application of a high frequency voltage between the discharge electrodes; and a magnetic resonance section provided between the power booster circuit and the discharge circuit as a frequency multiplier section for extracting a multiplied frequency wave, which corresponds to higher harmonic wave components of the fundamental wave and has a multiplied frequency as high as two or more integer times of the predetermined frequency of the fundamental wave, wherein the magnetic resonance section includes a first resonance coil, a first capacitor connected to the first resonance coil, a second resonance coil and a second capacitor connected to the second resonance coil, the first resonance coil and the second resonance coil being provided to oppose each other with a predetermined spacing therebetween, wherein an inductance of the first resonance coil, an inductance of the second resonance coil, a capacitance of the first capacitor, a capacitance of the second capacitor and the multiplied frequency of the multiplied frequency wave are determined such that a resonance frequency of the power booster circuit and the first resonance coil is matched to equal the multiplied frequency of the multiplied frequency wave, and matched to equal a resonance frequency of the discharge circuit and the second resonance coil when the discharge electrodes are in a predetermined pressure range, outside of which the resonance frequency of the discharge circuit and the second resonance coil varies.

2. A high frequency plasma ignition device for an internal combustion engine having a combustion chamber, the plasma ignition device comprising:

a high voltage DC power source for supplying a high voltage across the discharge electrodes; and a high frequency power source including the high frequency plasma generation system according to claim 1, wherein the discharge electrodes are provided in the combustion chamber for igniting fuel mixture suctioned into the combustion chamber, and wherein the high frequency power source applies a high frequency voltage to discharge high frequency current to generate between discharge electrodes a high frequency plasma triggered by a dielectric breakdown by application of the high voltage from the high voltage DC power source.

3. The plasma ignition device according to claim 2, wherein:

the high frequency power source includes a connector section formed of a series circuit of the first resonance coil and the first capacitor;

the discharge circuit includes a parallel circuit of the second resonance coil and the second capacitor;

the discharge electrodes are provided in parallel to the second resonance coil and the second capacitor to form a plug section; and both of the first resonance coil and the second resonance coil have high Q-factor of resonance and a resonance frequency of the connector section and the resonance frequency of the plug section are matched to equal each other.

4. The plasma ignition device according to claim 2, wherein:

the second resonance coil and the second capacitor are connected in parallel relation to a parasitic capacitance representing a discharge space between the discharge electrodes of the discharge circuit.

5. The plasma ignition device according to claim 4, wherein:

a series circuit of a resistor and a coil is connected in series between the second resonance coil and the second capacitor.

6. The plasma ignition device according to claim 4, wherein:

the parasitic capacitance changes in an inverse relation to a change in pressure of the discharge space.

7. The plasma ignition device according to claim 4, wherein:

the resonance frequency of the second resonance coil and the discharge circuit changes in proportion to a square root of the pressure in the discharge space.

8. The plasma ignition device according to claim 2, further comprising:

a current detector for detecting a current supplied to the first resonance coil; and a feedback circuit for feedback-controlling the fundamental wave generated by the frequency generator based on the current detected by the current detector.

* * * * *